US006383041B1

(12) United States Patent
Gronau

(10) Patent No.: US 6,383,041 B1
(45) Date of Patent: May 7, 2002

(54) RUDDER MECHANISM FOR JET PROPELLED PERSONAL WATERCRAFT

(75) Inventor: Edwin E. Gronau, 4156 Navajo St., Gladwin, MI (US) 48624

(73) Assignees: Peter D. Keefe, Roseville; Edwin E. Gronau, Gladwin, both of MI (US)

( * ) Notice: Subject to any disclaimer, the term of this patent is extended or adjusted under 35 U.S.C. 154(b) by 0 days.

(21) Appl. No.: 09/774,213

(22) Filed: Jan. 30, 2001

(51) Int. Cl.[7] ..... B63H 11/117
(52) U.S. Cl. ..... 440/43; 440/38
(58) Field of Search ..... 440/38, 43; 114/151

(56) References Cited

U.S. PATENT DOCUMENTS 3,982,494 A * 9/1976 Posti ..... 440/43
4,779,553 A * 10/1988 Wildhaber ..... 114/151
5,256,090 A 10/1993 Woolley
5,421,753 A * 6/1995 Roos ..... 440/43
5,988,091 A 11/1999 Willis
6,086,437 A * 7/2000 Murray ..... 440/43
6,113,443 A 9/2000 Eichinger

* cited by examiner

*Primary Examiner*—Jesus D. Sotelo
(74) *Attorney, Agent, or Firm*—Peter D. Keefe

(57) ABSTRACT

A rudder assembly for interfacing with a jet nozzle of a water jet propelled watercraft so as to thereby provide steering of the watercraft by pivoting of the jet nozzle even when a water jet is absent from the jet nozzle. A rudder is connected to a sleeve, wherein the sleeve is connected to the jet nozzle. In a first preferred form, the rudder extends in-line with, and immediately behind (aft of), the jet nozzle so as to be located in the water jet. In a second preferred form of the present invention, the rudder is notched adjacent the sleeve for accommodating movement of a thrust plate of a water jet propelled watercraft equipped with a thrust plate mechanism. Alternatively, the rudder may be located dependingly downward from the jet nozzle.

19 Claims, 4 Drawing Sheets

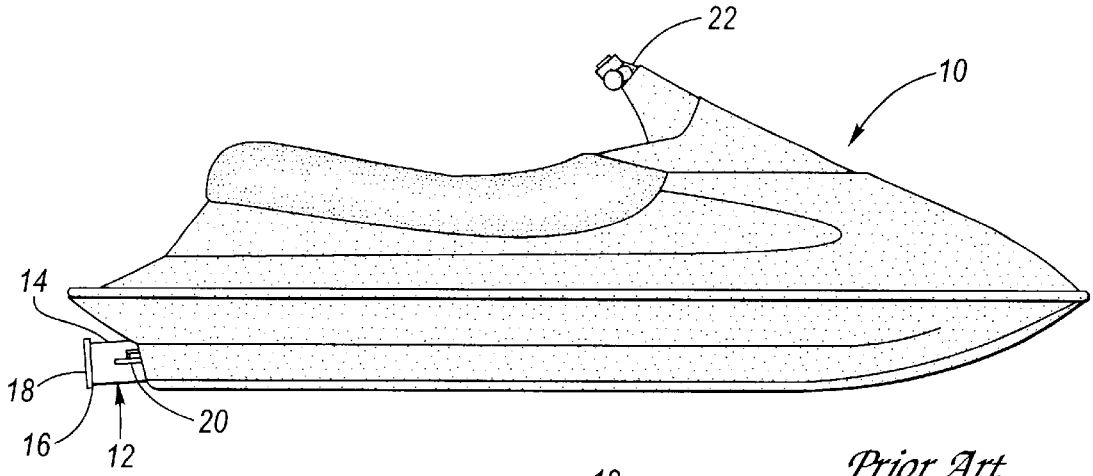
Prior Art
Fig. 1
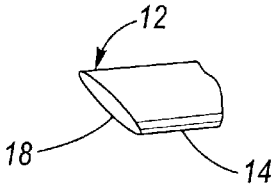
Fig. 1A
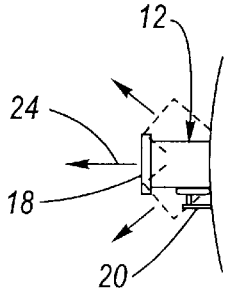
Fig. 1B
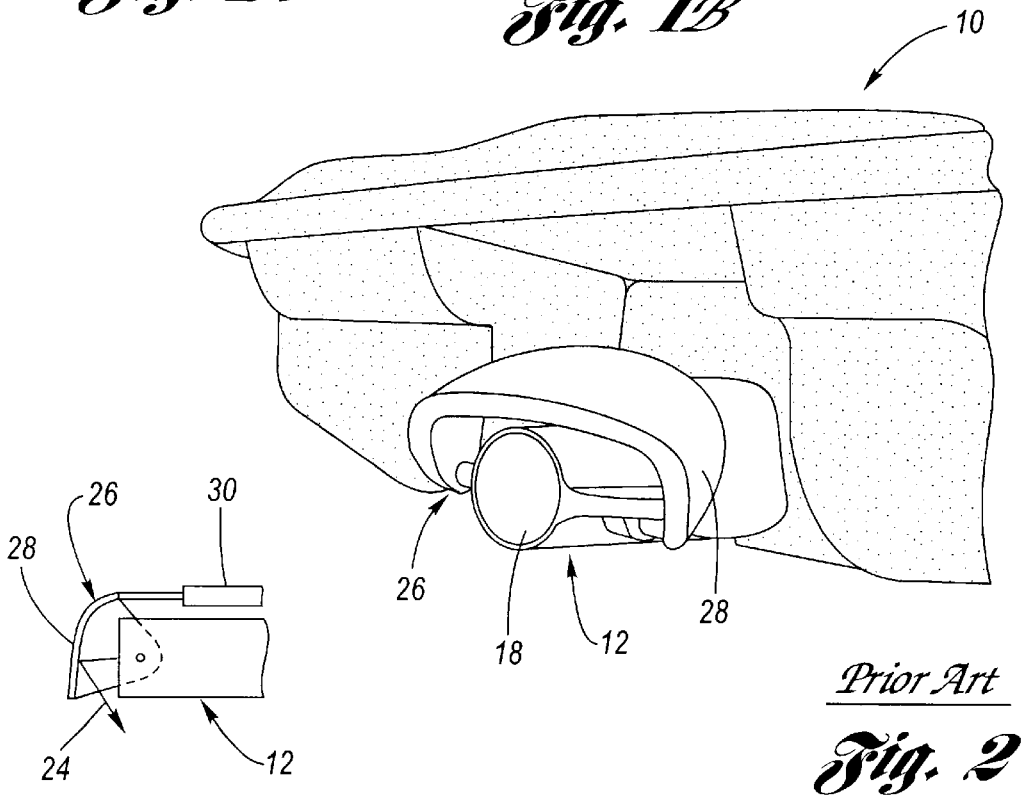
Prior Art
Fig. 2
Fig. 2A

RUDDER MECHANISM FOR JET PROPELLED PERSONAL WATERCRAFT

BACKGROUND OF THE INVENTION

1. Field of the Invention:

The present invention relates to water jet propelled watercraft, and more particularly to a rudder connected to the jet nozzle thereof as an aid to steering.

2. Description of the Prior Art:

Water jet propelled watercraft, including runabouts, cruisers, and personal watercraft (sometimes variously referred to as "jet skis" or "wave runners" among other appellations), are powerboats, wherein the engine provides a jet of water exited from a jet nozzle at the stern of the vessel to propel the vessel, wherein steering is accomplished by pivoting of the jet nozzle. Water jet propelled watercraft have become increasingly popular, and have now become as regular a sight on a body of water as any other type of vessel, such as conventional outboard and out drive power boats and sailboats. One reason for this immense popularity is the excitement these vessels provide as they encounter waves at high speed. Another reason is the jet system provides a very shallow draft for the vessel that is completely unobstructed, whereby the water jet propelled watercraft can be operated in shallow waters impossible for conventional vessels powered by outboard or inboard drive systems.

By way of an example of a jet propelled watercraft, FIGS. 1 through 2A depict two typical designs for personal watercraft 10. FIG. 1 depicts a personal watercraft having a simple exit jet nozzle 12. The jet nozzle 12 typically has a cylindrical cross-section, and has an outer sidewall 14 which may or may not be provided with a flange 16 at its end 18. The end 18 may be in the form of a straight end (as shown at FIG. 1) or in the form of a flared end (as shown at FIG. 1A). The jet nozzle 12 is pivotal in the starboard-port plane (as shown at FIG. 1B), wherein a steering linkage 20 is connected between the jet nozzle and a steering device, typically a steering wheel or a handle bar 22. The internal engine produces a water jet 24 which exits the end 18 of the jet nozzle 12 in a line directly with that of the cylindrical axis of the jet nozzle. Accordingly, by pivoting the jet nozzle 12, as shown at FIG. 1B, not only is the personal watercraft propelled forward, but its direction of movement is user selectable. FIGS. 2 and 2A depict a personal watercraft variation, wherein the jet nozzle 12 is associated with a thrust plate mechanism 26. In this regard, a thrust plate 28 is pivotable by user selection (as for example by hydraulics 30) between a stored position (shown at FIG. 2) to a deployed position (shown at FIG. 2A). When in the stored position the thrust plate is out of the way of the water jet. However, when at the deployed position, the thrust plate occludes the water jet 24, causing the water jet to divert so as to serve a braking effect upon the personal watercraft 10.

The personal watercraft components discussed hereinabove and shown at FIGS. 1 though 2A, are exemplary of a jet propelled watercaft, the components being generally referred to as a water jet propelled watercraft body assembly.

Pivoting of the jet nozzle provides excellent steering control of a water jet propelled watercraft only so long as a powerful water jet is exiting therefrom. As the water jet is diminished in strength, steering becomes aftendantly less certain. Indeed, should the water jet be stopped, steering then becomes impossible.

The inability of an operator of a water jet propelled watercraft to steer the vessel when the water jet is small or nonexistent is the source of many accidents. For example, an operator who is fast approaching a dock might cut power to the engine in the hopes of averting a collision at high speed, only to promote inevitability of the collision because the act of cutting the engine also cut steering control.

Accordingly, what remains urgently needed in the water jet propelled watercraft industry is a structure which allows for steering even if power to the engine is cut.

SUMMARY OF THE INVENTION

The present invention is a rudder assembly for interfacing with a jet nozzle of a water jet propelled watercraft so as to thereby provide steering of the watercraft by pivoting of the jet nozzle even when a water jet is absent from the jet nozzle.

In a preferred construction of the present invention, a rudder is connected to a sleeve, wherein the sleeve is connected to the jet nozzle of a water jet propelled watercraft. In a first preferred form of the present invention, the rudder is generally concentrically disposed in relation to the sleeve and positioned immediately behind (aft of), the jet nozzle so as to be located in the water jet. In a second preferred form of the present invention, the rudder is notched adjacent the sleeve for accommodating movement of a thrust plate of a water jet propelled watercraft equipped with a thrust plate mechanism. In either of the foregoing preferred embodiments, the rudder may be removably connected onto the jet nozzle or may be permanently connected thereto.

It is preferred for the rudder to be sized commensurately with the size of the jet nozzle. The sleeve preferably includes a stabilizing structure, as for example a stiffening brace for abutting an interior surface of the jet nozzle or connecting to opposing sides of the sleeve.

Alternatively, the rudder may be located other than in-line with the jet nozzle, as for example depending downwardly therefrom, for example extending below the keel of the water jet propelled watercraft.

Accordingly, it is an object of the present invention to provide a rudder assembly for a water jet propelled watercraft, the rudder providing steering of the water jet propelled watercraft pursuant to pivoting of the jet nozzle, even in the absence of a water jet.

This, and additional objects, advantages, features and benefits of the present invention will become apparent from the following specification.

BRIEF DESCRIPTION OF THE DRAWINGS

FIG. 1 is a side view of a prior art water jet propelled watercraft of the personal watercraft type.

FIG. 1A is a fragmented side view of a prior art alternative jet nozzle of the water jet propelled watercraft of FIG. 1.

FIG. 1B is a top plan view of the jet nozzle of the water jet propelled watercraft of FIG. 1.

FIG. 2 is a rear perspective view of an alternative prior art water jet propelled watercraft equipped with a thrust plate mechanism.

FIG. 2A is a fragmented side view of the jet nozzle of FIG. 2, showing the thrust plate in its deployed position.

DETAILED DESCRIPTION OF THE PREFERRED EMBODIMENT

Figure 3:
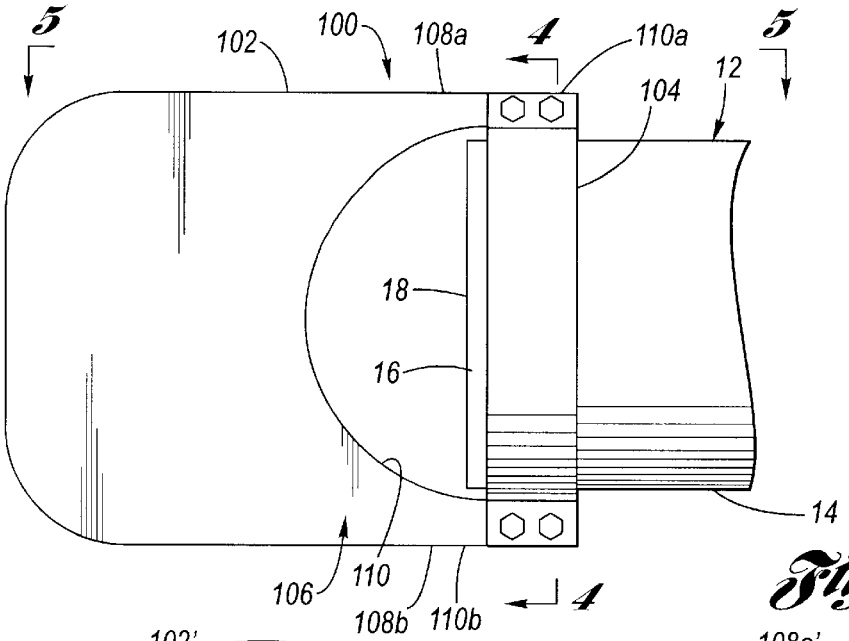
FIG. 3 is a side view of a rudder assembly according to a first form of the present invention, shown mounted to a jet nozzle of a water jet propelled watercraft.

Referring now to the Drawing from FIGS. 3 through 13, preferred examples of the rudder assembly according to the present invention will be discussed.

Figure 4:
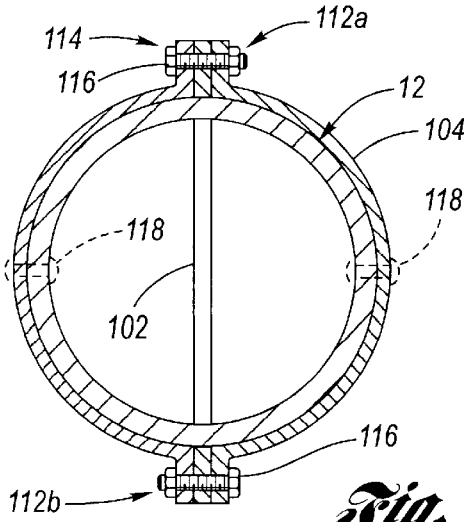
FIG. 4 is a partly sectional view of the rudder assembly and jet nozzle, seen along line 4—4 of FIG. 3.
Figure 5:
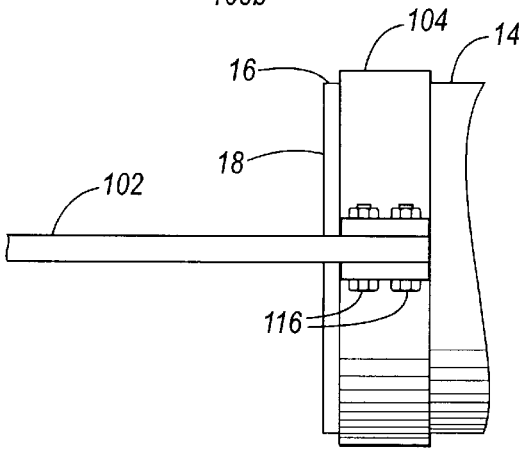
FIG. 5 is a top plan view of the rudder assembly and jet nozzle, seen along line 5—5 of FIG. 3.
Figure 6:
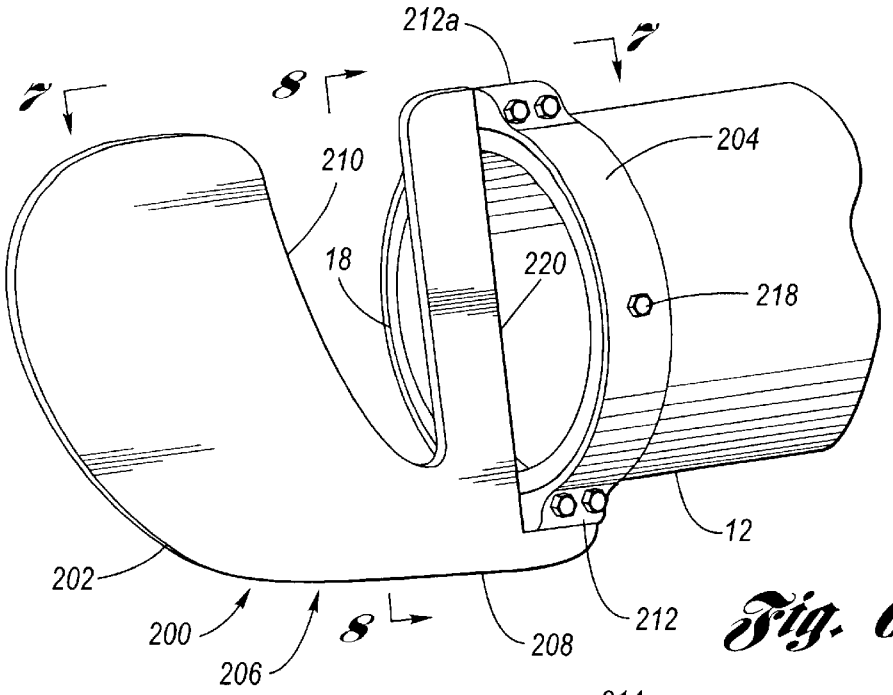
FIG. 6 is a perspective view of a rudder assembly according to a second form of the present invention, shown mounted to a jet nozzle of a water jet propelled watercraft having a thrust plate mechanism.
Figure 7:
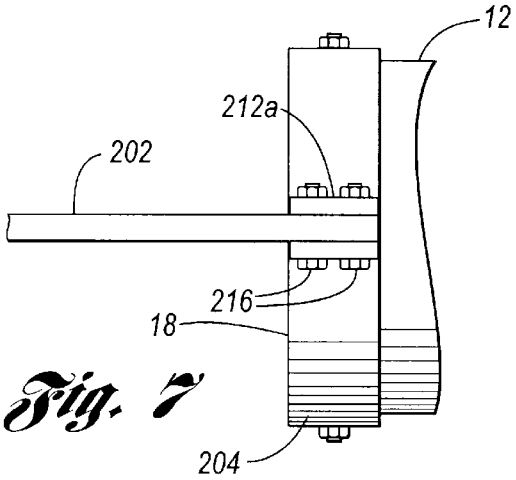
FIG. 7 is a top plan view of the rudder assembly and jet nozzle; seen along line 7—7 of FIG. 6.
Figure 8:
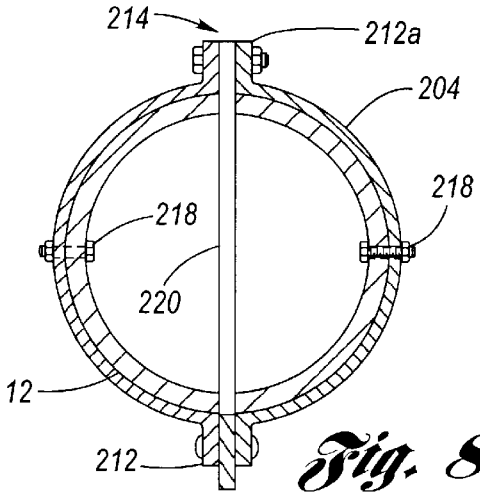
FIG. 8 is a partly sectional view of the rudder assembly and jet nozzle, seen along line 8—8 of FIG. 6.

FIGS. 3 through 5 depict a first form of the rudder assembly 100, wherein a rudder 102 is connected to a sleeve 104. The sleeve 104 is connected onto a jet nozzle 12 such that the rudder 102 is located directly behind the nozzle end 18 and in the water jet which exits the jet nozzle.

The rudder 102 is preferably composed of a strong, durable and corrosion resistant material, such as anodized aluminum or a high impact resistant plastic. The rudder 102 is generally thin, as depicted at FIG. 5, in relation to the cross-section of the jet nozzle end 18. A thinnest possible rudder is preferred, wherein the thinness is limited by structural considerations, as for example becoming too thin to retain stiffness or having edges which are sharp. The rudder 102 is preferably dimensioned to be generally cross-sectioned in terms of its height and length comparably with respect to the cross-section of the jet nozzle 12, but this is not a requirement. Indeed, the rudder 102 may be any size which is just sufficient, on a small scale, to provide steering when the water jet is absent, yet not too large on a large scale, so as to in some noticeable manner unduly hamper the operation of the water jet propelled watercraft.

The rudder 102 is connected at its forward end 106 in generally concentric relation to the sleeve 104. This connection may be via any mechanical modality, a preferred modality being a pair of opposed legs 108*a*, 108*b*. In this regard, it is preferred to provide a concave relief 110 in the forward end 106 of the rudder as between the opposed legs. Each of the legs 108*a*, 108*b* is connected to the sleeve 104 in mutually diametrically opposed relation, such as for example by being connected to respective feet 112*a*, 112*b* and being riveted or bolted thereto.

The sleeve 104 may be sized to precisely fit engirdly onto a predetermined jet nozzle 12, or may be adjustable, as for example so as to fit over a flange 16 (if present). For example, one foot 112*a* serves as a break-point 114 in the sleeve 104, which break-point is closed when fasteners 116 (ie., bolts, rivets, etc.) are fastened thereto. When fastened, the bolts rivets, etc. cause the sleeve 104 to tighten onto the jet nozzle outer sidewall 14. Generally, if the sleeve 104 is tight onto the outer sidewall 14 and a flange 16 is present, nothing more need be done to attach the rudder assembly 100 to the jet nozzle 12. However, of course, a flange 16 need not be present. In the absence of a flange (including the case of a flared end jet nozzle), it is preferred for at least two opposingly arranged fasteners 118 (ie., bolts, rivets, etc.) secured through the sidewall of the jet nozzle 12 and through the sleeve 114 to thereby assuredly secure the sleeve onto the jet nozzle (see FIG. 4).

Figure 3A:
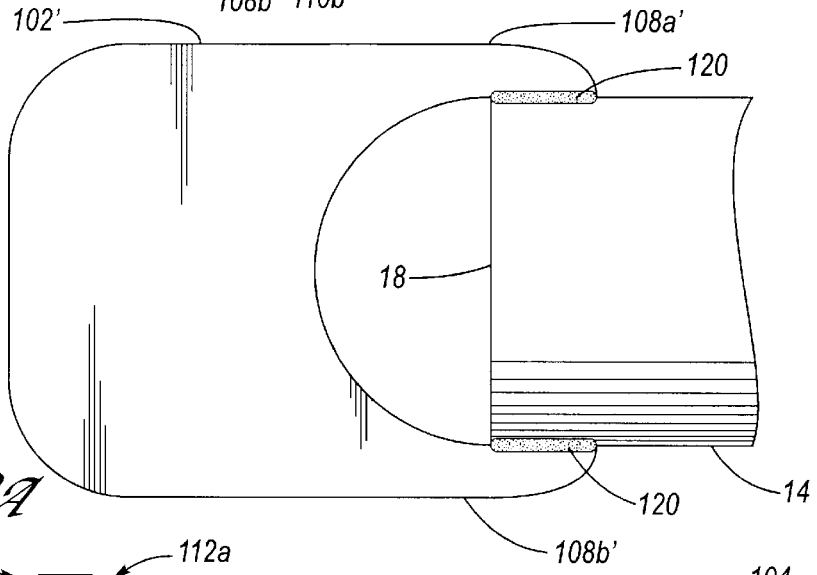
FIG. 3A is a side view similar to FIG. 3, wherein the rudder is shown permanently attached to a jet nozzle.

It is to be understood that the sleeve shape matches the cross-sectional shape of the outer sidewall 16, as for example being circular, elliptical or rectangular. Also, it is to be understood that the rudder may be attached to the jet nozzle 12 in any mechanical manner. For example, the rudder may be welded or adhesively secured to the jet nozzle in a permanent fashion, with or without utilization of the sleeve. An example of permanent attachment without the sleeve is shown at FIG. 3A, wherein welds 120 permanently connect the legs 108*a*', 108*b*' of a rudder 102' directly onto the jet nozzle 14 (shown without a flange).

Turning attention now to FIGS. 6 through 10, a second form of the rudder assembly 200 is shown, wherein a rudder 202 is connected in generally concentric relation to a sleeve 204. As in the first form of the rudder assembly 100, the sleeve 204 is connected onto the jet nozzle 12 such that the rudder 202 is located directly behind the nozzle end 18 and in the water jet which exits the jet nozzle. However, now accommodation is made for the deployment of a thrust plate 28.

The rudder 202 is constituted as generally discussed hereinabove, but an upper notch 210 is provided at the forward end 206. The upper notch 210 provides clearance for a thrust plate 28 when at its deployed position (see FIG. 9). The rudder 202 is connected at its forward end 206 to the sleeve 204 via any mechanical modality, a preferred modality being a lower leg 208. The lower leg 208 is connected to the sleeve 204, such as for example by being connected to a foot 212 and being riveted or bolted thereto.

In order to add stability to the rudder 202, it is preferred to connect a stiffening brace 220 to the lower leg 208, and further to provide a second foot 212*a* opposite the aforesaid foot 212, wherein the stiffening brace is connected to the second foot via fasteners 216.

The sleeve 204 may be sized to precisely fit onto a predetermined jet nozzle 12, or may be adjustable, as for example so as to fit over a flange (if present). For example as recounted hereinabove with respect to the first form of rudder assembly 100, one foot 212*a* serves as a break-point 214 in the sleeve 204, which break-point is closed when fasteners 216 (ie., bolts, rivets, etc.) are fastened thereto. When fastened, the bolts rivets, etc. cause the sleeve 204 to tighten onto the jet nozzle outer sidewall 14.

Generally, if the sleeve 204 is tight onto the outer sidewall 14 and a flange 16 is present, nothing more need be done to attach the rudder assembly 200 to the jet nozzle 12. However, as mentioned previously a flange need not be present. In the absence of a flange (including the case of a flared end jet nozzle, shown at FIG. 9), it is preferred for at least two opposingly arranged fasteners 218 (ie., bolts, rivets, etc.) secured through the sidewall of the jet nozzle 12 and through the sleeve 214 to thereby assuredly secure the sleeve onto the jet nozzle (see FIGS. 8 and 10). Other connection modalities of the rudder to the jet nozzle may be used, as for example welding or an adhesive with or without the sleeve (an example of a permanent attachment without the sleeve being to connect the lower leg and the stiffening brace directly to the jet nozzle).

Figure 9:
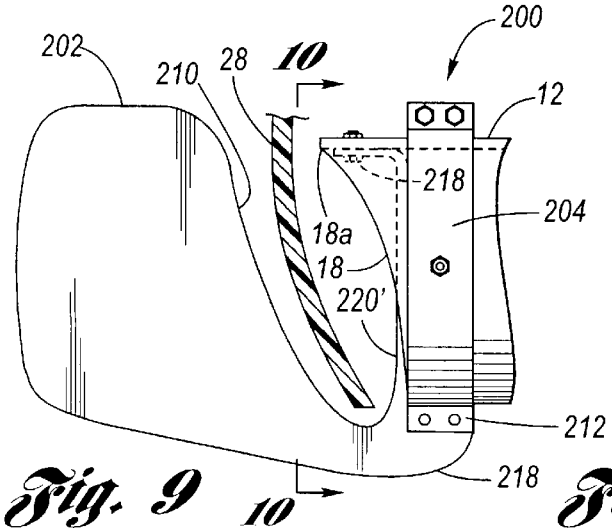
FIG. 9 is a side view of a rudder assembly according to the second form of the present invention, shown mounted to a flared end jet nozzle of a water jet propelled watercraft having a thrust plate mechanism.
Figure 10:
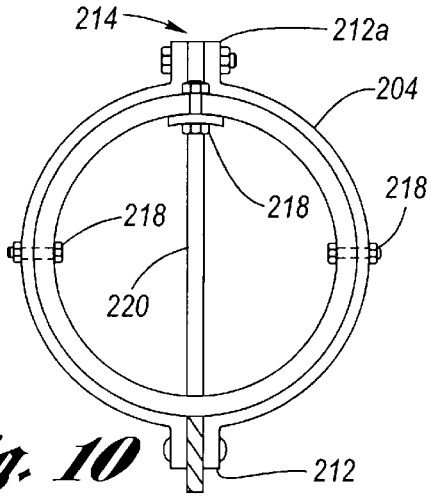
FIG. 10 is a partly sectional view of the rudder assembly and jet nozzle, seen along line 10—10 of FIG. 9.

FIGS. 9 and 10 depict a variation of the second form of rudder assembly 200, wherein the stiffening brace 220' is modified to be connected by a fastener 218 directly to the jet nozzle at the flared overhang 18a of the flared end 18. The second foot 212*a* may be retained or obviated (the break-point then being located at the foot 212).

Figure 11:
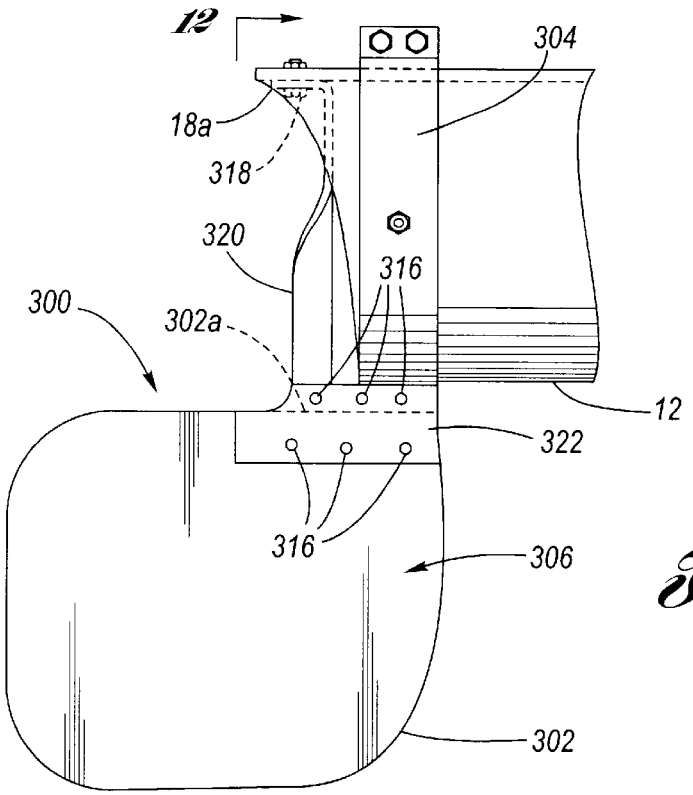
FIG. 11 is a side view of a rudder assembly according to a third form of the present invention, shown mounted to a flared end jet nozzle of a water jet propelled watercraft.
Figure 12:
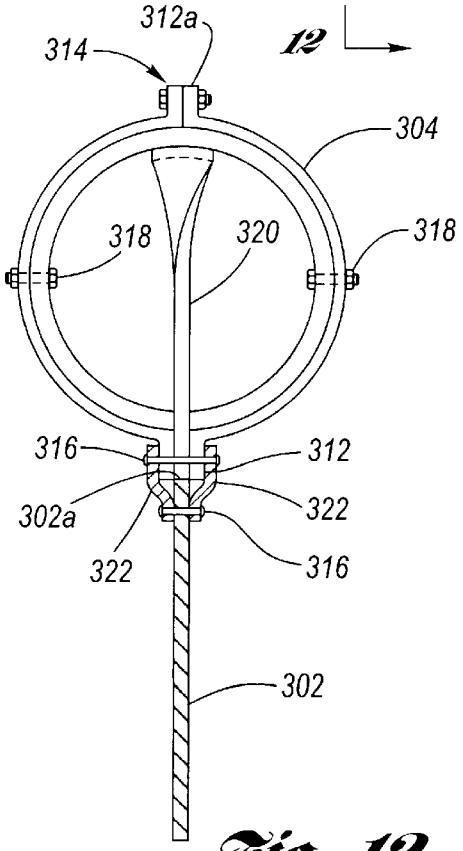
FIG. 12 is a partly sectional view of the rudder assembly and jet nozzle, seen along line 12—12 of FIG. 11.
Figure 13:
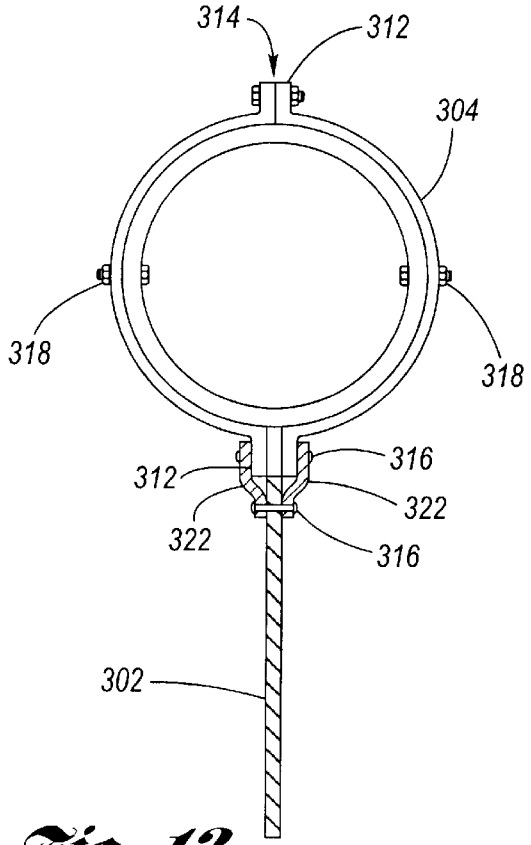
FIG. 13 is a view as in FIG. 12, wherein a stiffening brace been eliminated.

Turning attention now to FIGS. 11 through 13, a third form of the rudder assembly 300 is shown, wherein a rudder 302 is connected to a sleeve 304. As in the first form of the rudder assembly 100, the sleeve 304 is connected onto the jet nozzle 12, wherein now the rudder 302 is located directly beneath the nozzle end 18 and beneath the water jet, even so far, optionally, as to be beneath the keel. This configuration may be used for any water jet propelled watercraft, including water jet propelled watercraft having a thrust plate mechanism.

The rudder 302 is constituted as generally discussed hereinabove; however, now the upper edge 302*a* of the rudder at its forward end 306 is connected to the sleeve 304. This connection may be accomplished by any mechanical modality. For example, a foot 312 formed of the sleeve may be riveted to the upper edge 302*a* utilizing rivets 316 and stiffening plates 322 on either side.

In order to add stability to the rudder 302, it is preferred to connect a stiffening brace 320 to the upper edge 302*a* via, for example the stiffening plates 322 (see FIG. 12). Where there is no flared overhang, the stiffening brace 320 is connected to a second foot 312*a* opposite the aforesaid foot 312, wherein the stiffening brace is connected to the second foot via fasteners as described hereinabove with respect to the second form of the rudder assembly 200. However, where there is a flared overhang 18*a*, the stiffening brace 320 is connected thereto via a fastener 318.

The sleeve 304 may be sized to precisely fit onto a predetermined jet nozzle 12, or may be adjustable, as for example so as to fit over a flange (if present). For example as recounted hereinabove with respect to the first form of rudder assembly 100, one foot, as for example the second foot 312*a*, serves as a break-point 314 in the sleeve 304, which break-point is closed when fasteners 316 (ie., bolts, rivets, etc.) are fastened thereto. When fastened, the bolts rivets, etc. cause the sleeve 304 to tighten onto the jet nozzle outer sidewall 14.

Generally, if the sleeve 304 is tight onto the outer sidewall 14 and a flange 16 is present, nothing more need be done to attach the rudder assembly 300 to the jet nozzle 12. However as mentioned previously, a flange need not be present. In the absence of a flange (including the case of a flared end jet nozzle, shown at FIG. 11), it is preferred for at least two opposingly arranged fasteners 318 (ie., bolts, rivets, etc.) secured through the sidewall of the jet nozzle 12 and through the sleeve 314 to thereby assuredly secure the sleeve onto the jet nozzle. Other connection modalities of the rudder to the jet nozzle may be used, as for example welding or an adhesive with or without the sleeve (an example of a permanent attachment without the sleeve being to connect the upper edge directly to the jet nozzle).

FIG. 13 depicts a variation of the third form of rudder assembly 300, wherein the stiffening brace is not provided.

In operation of the rudder assembly 100, 200, 300, an operator of a water jet propelled watercraft operates the vessel in a generally conventional manner when under power. In those occasions when the vessel is moving through the water but the water jet is weak or nonexistent, by pivoting the jet nozzle, the rudder serves to cause water diversion sufficient to provide steering of the water jet propelled watercraft. This steering can save the operator from the calamity of a collision, in that steering is possible even though there is no water jet exiting the jet nozzle. Accordingly, the present invention is a major improvement in water jet propelled watercraft safety.

It is to be understood that the present invention is installable as an aftermarket device, or as an original equipment manufacturer device, applicable to any type of water jet propelled watercraft, having or not having a thrust plate mechanism.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A rudder assembly for a water jet propelled watercraft having a jet nozzle, said rudder assembly comprising:

a rudder; and a sleeve connected to said rudder, said sleeve being structured to engird a jet nozzle of a water jet propelled watercraft, wherein said rudder is generally centrally aligned with respect to said sleeve and disposed directly aft of said jet nozzle.

2. The rudder assembly of claim 1, wherein said rudder has a forward end, said rudder further comprising a first leg connected to said forward end and a second leg connected to said forward end, wherein said first and second legs connect to said sleeve at diametrically opposite locations of said sleeve.

3. The rudder assembly of claim 2, wherein a concave relief is formed in said forward end of said rudder between said first and second legs.

4. The rudder assembly of claim 2, wherein said sleeve has a break-point, said break-point being selectively adjustable with respect to the engirding.

5. The rudder assembly of claim 1, wherein said rudder has a forward end, said forward end comprising a lower leg connected to a first location of said sleeve, wherein an upper notch is formed in said rudder adjacent said sleeve and said lower leg.

6. The rudder assembly of claim 5, further comprising a stiffening brace connected to said lower leg and a second location of said sleeve which is diametrically opposite said first location.

7. The rudder assembly of claim 6, wherein said sleeve has a break-point, said break-point being selectively adjustable with respect to the engirding.

8. The rudder assembly of claim 5, further comprising a stiffening brace connected to said lower leg and connectable to a selected location of a jet nozzle.

9. The rudder assembly of claim 8, wherein said sleeve has a break-point, said break-point being selectively adjustable with respect to the engirding.

10. A water jet propelled watercraft comprising:

a water jet propelled watercraft body assembly, said water jet propelled watercraft body assembly including a jet nozzle;

a rudder; and a sleeve connected to said rudder, said sleeve engirding said jet nozzle, wherein said rudder is generally centrally aligned with respect to said sleeve and disposed directly aft of said jet nozzle.

11. The water jet propelled watercraft of claim 10, wherein said rudder has a forward end, said rudder further comprising a first leg connected to said forward end and a second leg connected to said forward end, wherein said first and second legs connect to said sleeve at diametrically opposite locations of said sleeve.

12. The water jet propelled watercraft of claim 11, further comprising fasteners attaching said sleeve to said jet nozzle.

13. The water jet propelled watercraft of claim 11, wherein said sleeve has a break-point, said break-point being selectively adjustable with respect to the engirding.

14. The water jet propelled watercraft of claim 10, wherein said rudder has a forward end, said forward end comprising a lower leg connected to a first location of said sleeve, wherein an upper notch is formed in said rudder adjacent said sleeve and said lower leg.

15. The water jet propelled watercraft of claim 14, further comprising a stiffening brace connected to said lower leg and a second location of said sleeve which is diametrically opposite said first location.

16. The water jet propelled watercraft of claim 14, wherein said sleeve has a break-point, said break-point being selectively adjustable with respect to the engirding.

17. The water jet propelled watercraft of claim 14, further comprising a stiffening brace connected to said lower leg and said jet nozzle.

18. The water jet propelled watercraft of claim 14, further comprising fasteners connecting said sleeve to said jet nozzle.

19. In a water jet propelled watercraft, the improvement comprising:

a jet nozzle having a rearward end; and a rudder permanently attached to said jet nozzle, said rudder being generally centrally aligned with respect to said jet nozzle and disposed directly aft thereof.

* * * * *